US006257411B1

(12) United States Patent
Bacques et al.

(10) Patent No.: US 6,257,411 B1
(45) Date of Patent: Jul. 10, 2001

(54) CASE MADE OF SHEET MATERIAL WITH CENTERING TABS AND BLANK FOR PRODUCING SAME

(75) Inventors: Jean-Yves Bacques, Paris; Gérard Mathieu, Cergy, both of (FR)

(73) Assignee: Otor

( * ) Notice: Subject to any disclaimer, the term of this patent is extended or adjusted under 35 U.S.C. 154(b) by 0 days.

(21) Appl. No.: 09/331,222

(22) PCT Filed: Dec. 23, 1997

(86) PCT No.: PCT/FR97/02410

§ 371 Date: Aug. 6, 1999

§ 102(e) Date: Aug. 6, 1999

(87) PCT Pub. No.: WO98/29316

PCT Pub. Date: Jul. 9, 1998

(30) Foreign Application Priority Data

Dec. 27, 1996 (FR) ..... 96 16138

(51) Int. Cl.[7] ..... B65D 21/032

(52) U.S. Cl. ..... 206/511; 206/508; 206/509; 229/915

(58) Field of Search ..... 229/132, 915; 206/508, 509, 511

(56) References Cited

U.S. PATENT DOCUMENTS

| | | | | |
|---|---|---|---|---|
| 2,719,664 | * | 10/1955 | Hester | 229/915 |
| 2,843,307 | * | 7/1958 | Goltz | 209/509 |
| 3,287,075 | * | 11/1966 | Barke et al. | 206/509 |
| 4,261,503 | | 4/1981 | Lawrence et al. . | |
| 4,383,636 | * | 5/1983 | Chaffers | 229/915 |
| 4,830,282 | | 5/1989 | Knight, Jr. . | |
| 5,662,508 | * | 9/1997 | Smith | 229/915 |

FOREIGN PATENT DOCUMENTS

| | | |
|---|---|---|
| 0 567 412 | 10/1993 | (EP) . |
| 2 128 080 | 10/1972 | (FR) . |
| 2 311 717 | 12/1976 | (FR) . |
| 2 542 713 | 9/1984 | (FR) . |
| 2 691 732 | 11/1993 | (FR) . |

* cited by examiner

*Primary Examiner*—Gary E. Elkins
(74) *Attorney, Agent, or Firm*—Merchant & Gould P.C.

(57) ABSTRACT

The invention concerns a case and a blank made of sheet corrugated cardboard or the like, the case having a polygonal cross section, having side faces, an upper face forming a lid, and a lower face forming the bottom of the case. The lid has at least two tabs located on two opposite sides of the lid, cut from the upper face or from side faces adjacent the upper face. The bottom has at least two recesses on its lower surface corresponding to the tabs, complementary in shape to the tabs and arranged such that the recesses fit into the tabs of a case stacked beneath.

31 Claims, 7 Drawing Sheets

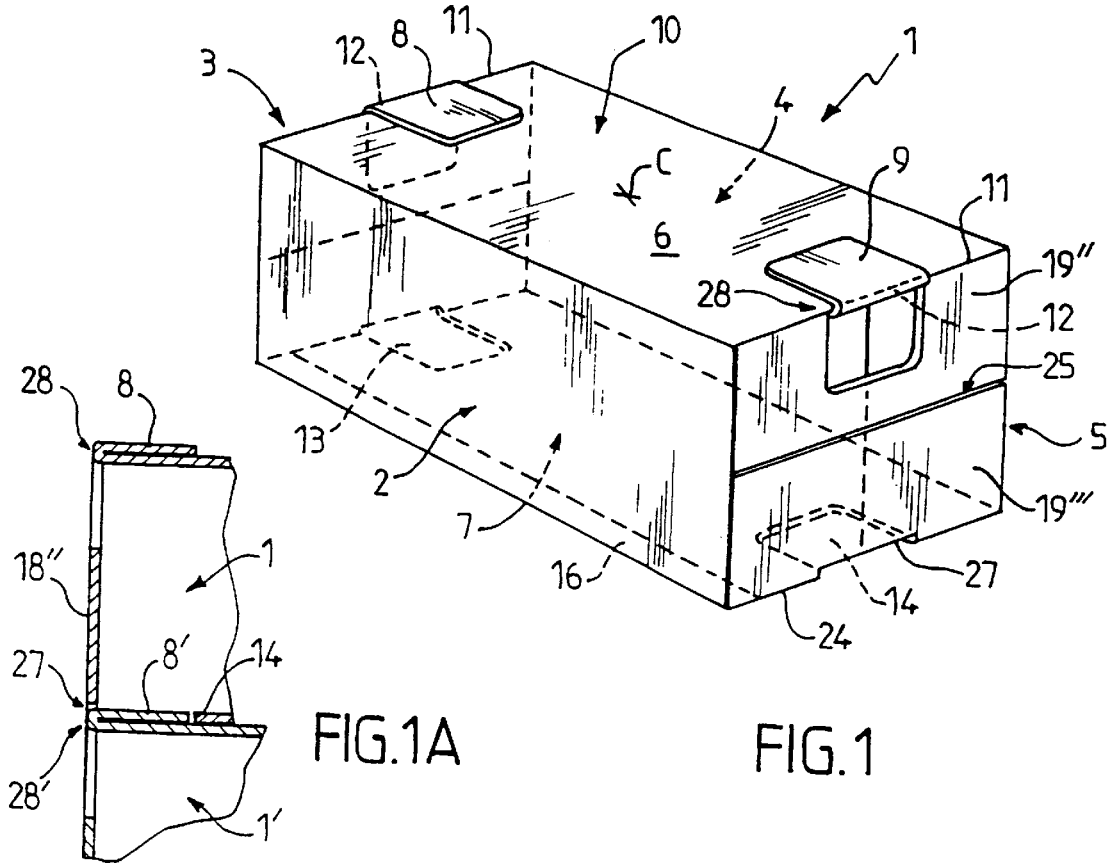
FIG.1A
FIG.1
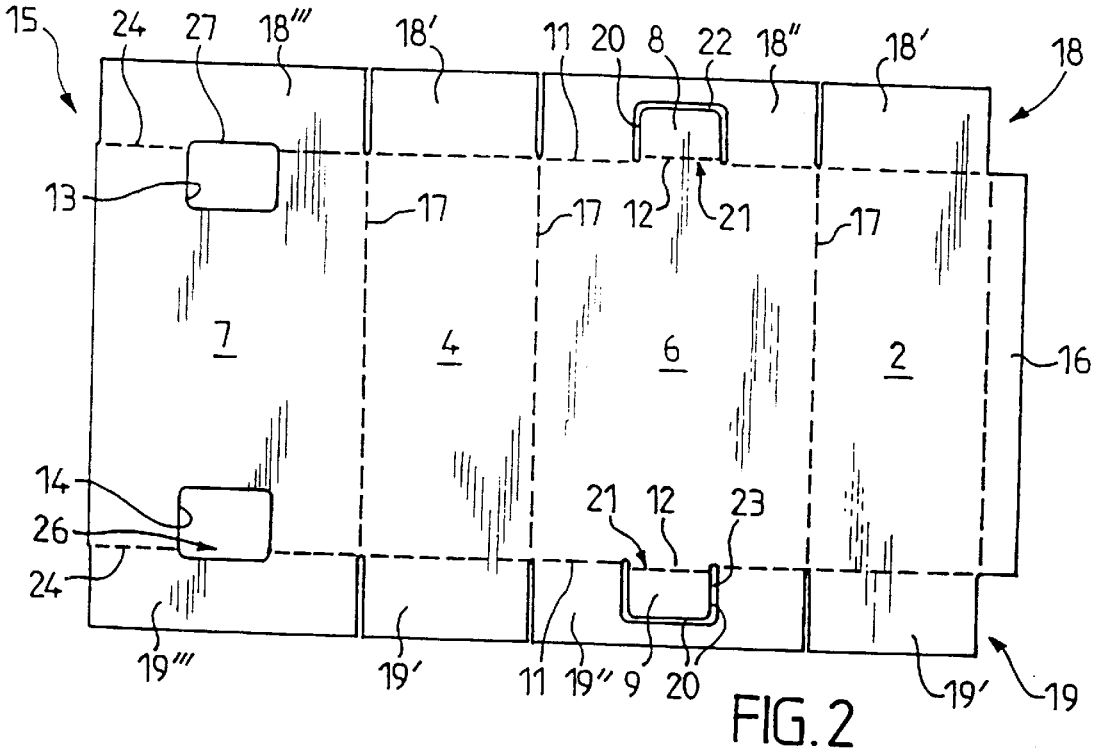
FIG.2

CASE MADE OF SHEET MATERIAL WITH CENTERING TABS AND BLANK FOR PRODUCING SAME

The present invention relates to a carton made of corrugated cardboard sheet material or the like, of the type exhibiting a polygonal cross section, comprising lateral faces, an upper face forming a cover and a lower face forming the bottom of the carton.

It relates also to a blank for making such a carton.

It finds a particularly important, although not exclusive, application in the field of cartons which can be stacked on pallets, where there is a tendency for the lower cartons to be crushed should the size of the stack be too big.

The invention is also applicable to polygonal cartons with more than four sides which may exhibit, when they are not filled completely, deformations in the event of lateral loading, as well as inferior resistance to compression.

Carton centering systems using lateral tenons which cooperate with orifices placed on the edges of packages are already known. Such means are fragile and do not withstand repeated manipulations.

Latching systems are also known which make it possible to lock a box cover, thereby subsequently avoiding these untimely deformations. They involve in particular latching with adhesive tapes. Such systems nevertheless have drawbacks. Indeed, they require an additional constituent element of the carton, namely the adhesive tape and thereby entail additional costs and operations during manufacture.

The aim of the present invention is to provide a box and a blank which are better than those previously known at meeting the requirements of the art in particular in that it proposes a centering of the cartons one above another, allowing perfect stacking of the cartons one above another, plumb with one another, this never having been achieved in the past, in an industrial and repetitive manner.

It has thus been possible to observe an improvement of 15% in resistance to compression of the cartons situated at the base of the pallet, for the same quality of cardboard, by virtue of the centering according to the invention.

Owing to the possibilities of perfect stacking which the centering according to the invention permits, the lower cartons are therefore better loaded in compression and more resistant.

With the invention, it is also possible to provide a system for latching the cover allowing good squaring up of the carton during its closure, which is simple and easy to implement, without extra costs and permitting definitive locking, thereby further improving the strength under compression.

For this purpose, the invention proposes in particular a carton of the type described above, characterized in that the cover comprises at least two tabs respectively situated on two opposite sides of the said cover and cut out on one side in a thickness of the upper face or in the lateral face adjacent to the said upper face, and articulated on the other side parallel to and in a manner substantially coincident with the join line between the said upper face and the adjacent lateral face, the said tabs respectively overlapping the outside surface of the said upper face to which they are glued, so that they constitute outgrowths projecting with respect to the said outside surface of the said upper face, and in that the bottom comprises at least two recesses corresponding to the said tabs, made in the said lower face, of complementary shape to the shapes of the tabs and laid out so as to engage with the tabs of a carton arranged underneath.

In advantageous embodiments, recourse is had moreover to one and/or other of the following arrangements:

the lower face and the lateral faces are formed by an open tray, the cover of the carton consisting of a leaf furnished with at least one lateral flap, at least one tab being cut out in the said lateral flap, the said tabs being turned over so as to be glued to the said leaf forming the upper face;

the lower face and the lateral faces are formed from a blank comprising a set of at least four main leaves able to form the lateral faces, connected together by join lines, each main leaf being furnished with a lower flap, the said lower flaps being able to form the bottom of the carton, the cover of the carton consisting of a central leaf furnished with at least one lateral flap, at least one tab being cut out in the said lateral flap, the said tabs being turned over so as to be glued to the said central leaf forming the upper face;

the carton is formed from a blank comprising a set of at least four main leaves able to form the lateral faces, connected together by join lines, each main leaf being furnished with an upper flap and with a lower flap situated respectively on either side of the said main leaf, the said upper flaps being able to form the cover of the carton, the said lower flaps being able to form the bottom of the carton, the tabs being cut out in the lateral faces of the carton and the recesses being made in the lower flaps;

the carton is formed from a blank comprising a set of at least four main leaves able to form two lateral faces, the bottom and the cover of the carton, connected together by join lines, each main leaf being furnished with an upper flap and with a lower flap situated respectively on either side of the said main leaf, the said upper or lower flaps being able to form the other two lateral faces of the carton, and the tabs are cut out in the lower and upper flaps of a first leaf forming the cover, the recesses being made in a second leaf forming the bottom of the carton;

the bottom and the cover each comprise two opposite external flaps and two opposite internal flaps situated underneath the said external flaps, the said flaps being connected respectively to the lateral faces by fold lines and the two tabs are cut out on one side in the internal flaps, and articulated respectively on the other side parallel to the fold lines of the said internal flaps, the said external flaps being glued to the portions of internal flaps adjacent to the tabs and the said tabs respectively overlapping the said external flaps to which they are glued;

the external flaps comprise notches at the corners joining with the fold lines and the internal flaps comprise opposing end projecting parts snap-fitting into the said notches;

the external flaps comprise intermediate notches situated on the fold lines and the internal flaps comprise opposing end projecting parts snap-fitting into the said intermediate notches;

the carton comprises four pairwise opposite tabs glued to the external surface of the upper face forming the cover of the carton, and four opposing recesses in the lower face of the carton;

the tabs are cut out by making a peripheral recess around the said tabs;

each tab exhibits a rectangular or isosceles trapezoidal shape.

the cover comprises two centered slits situated respectively on either side of the cover, parallel to and at a specified distance from the join lines between lateral face and upper face furnished with glued tabs, the ends of the said slits being connected by rupture lines to the end corners joining with the said join lines, able to allow the opening of the carton by tearing off the said cover while pulling toward the outside of the carton from the two slits;

the carton has eight sides, namely four main sides separated by intermediate sides forming cut corners, and it is formed around a mandrel.

The invention also proposes a blank making it possible to obtain a carton such as described above.

It also proposes and in particular a blank or series of blanks made of corrugated cardboard sheet material or the like intended to form a carton with polygonal cross section, comprising lateral faces, an upper face forming a cover and a lower face forming the bottom of the carton, characterized in that it comprises a first blank or a first portion of blank intended to form the cover of the carton, the said first blank or the said first portion of blank comprising a leaf furnished with at least two lateral flaps, or comprising two so-called upper flaps, the said leaf or the two upper flaps being intended to form the said upper face, in that at least two of the said lateral flaps or the said upper flaps each comprise at least one tab cut out on one side in the said flap, and connected on the other side to the upper face or to the adjacent leaf by a fold line slightly offset with respect to the line of fold of the said flap with the said adjacent leaf, the said tabs being laid out so as to overlap respectively the upper face so as to be glued thereto, and in that it comprises a second blank or a second portion of blank able to constitute the bottom of the carton, comprising a lower leaf or comprising at least two lower flaps, the said lower leaf or the said two lower flaps being able to form the lower face of the carton and being furnished with indentations or with portions of indentations whose overall shape is complementary to that of a tab once the carton has been formed.

In an advantageous embodiment, the blank or series of blanks comprises a first blank or a first portion of blank intended to form the cover of the carton comprising a leaf furnished with lateral flaps, at least one tab being cut out in at least one of the said lateral flaps and laid out so as to be turned over and glued to the said leaf forming the upper face, and a second blank or a second portion of blank intended to form the bottom of the carton, comprising a rectangular central leaf furnished on each of its sides with a first flap supplemented in some cases with second lateral flaps able to form the lateral walls of the carton, the said central leaf comprising at least two recesses opposedly situated along lines of join with the first flaps, the said recesses being of complementary shape to that of the tabs and laid out so as to be plumb with the said tabs when the carton is formed.

In an advantageous embodiment, the blank comprises a set of at least four main leaves connected together by join lines, each main leaf being furnished on either side with an upper flap and with a lower flap respectively situated on either side of the said main leaf, a first main leaf being able to form the cover of the carton, and a second main leaf, not adjacent to the first main leaf, being able to form the bottom of the carton, and in that the tabs are cut out in the lower and upper flaps of the said first main leaf, the recesses being made in the second main leaf.

Advantageously, the blank comprises lateral leaves connected together by way of first parallel fold lines, a first series of flaps connected to one side of the said lateral leaves by second fold lines orthogonal to the said first fold lines, and able to form the bottom of the carton, and a second series of flaps connected to the other side of the said lateral leaves by third fold lines orthogonal to the said first fold lines, and able to form the cover of the carton, the said first and second series consisting of two lateral flaps termed external interspersed with two lateral flaps termed internal, characterized in that the said internal flaps of the cover each comprise a tab cut out on one side in the said flap, and connected on the other side to the adjacent leaf by a fold line substantially coincident with the third fold line of the said flap, the said external flaps being laid out so as to be glued to the internal portions of flaps adjacent to the tabs and the said tabs so as to overlap respectively the said external flaps to which they can be glued, and in that the lateral sides of the external flaps of the bottom comprise indentations of complementary shape to that of a half-tab.

Advantageously, the peripheral borders of the external flaps opposite the third fold lines respectively comprise two half-slits situated on either side of the said external flaps, at a specified distance from the lateral borders of the said corresponding flaps.

Likewise advantageously in another embodiment, the blank or series of blanks comprises two slits made in the leaf intended to form the cover of the carton.

In another advantageous embodiment, each end of slit or of half-slit is extended by a sectile or rupture line in the said cover over a specified distance, the said sectile line being directed on a slant toward the corner angle of the line of join with the adjacent lateral face and contiguous with a tab and being laid out so as to be situated toward the center of the cover and beyond the corresponding border of the said tab and points of gluing of the cover, when the said carton is formed.

Advantageously, each tab exhibits a rectangular or isosceles trapezoidal shape.

According to the invention more particularly described here, the tabs are moreover cut out by making a peripheral recess around the said tabs.

The invention will be better understood on reading the description which follows of embodiments given by way of non-limiting example.

It refers to the accompanying drawings in which:

FIG. 1 is a perspective view of a carton according to a first embodiment of the invention.

FIG. 1A is a diagrammatic and partial sectional view showing the principle of centering between two cartons of FIG. 1.

FIG. 2 is a plan view of the blank of FIG. 1.

Figure 3:
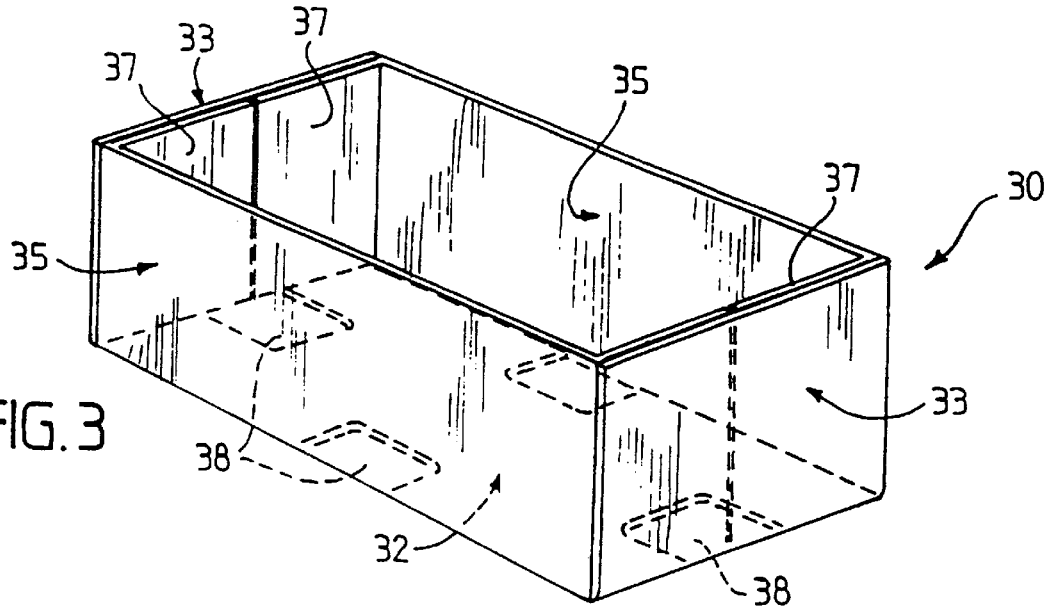
FIG. 3 is a perspective view of the lower part of a carton in the form of a tray, according to a second embodiment of the invention.

FIG. 1 shows a carton 1 made of for example double-faced or double-walled corrugated cardboard 3 mm or 5 mm thick, of parallepipedal shape, comprising four rectangular lateral faces 2, 3, 4 and 5, namely two opposing large faces 2 and 4 and two opposing small end faces 3 and 5.

The carton 1 also comprises an upper face 6 forming the cover of the carton and a lower face 7 forming the bottom of the carton.

According to this embodiment of the invention, the cover comprises two rectangular tabs 8 and 9, greater than 3 cm wide, for example 4 cm, and greater than 2 cm long, for example 4 cm long, of equal thickness to that of the cardboard, and respectively cut out in the lateral faces 3 and 5 adjacent to the upper face 6, on three sides of the said tabs, which are folded back and glued to the outside face 10 of the upper face, for example with so-called "hot melt" glue.

To do this, the tab is articulated on its fourth side parallel to and in a manner substantially coincident with the join line 11, between upper face and lateral face, around a double fold line 12 of which one line at least is offset toward the tab with respect to the join line 11.

The offsetting of the double line allows a recessing of the end of the tab on the side of its join line 12, engendering a bigger projection thereat which favors the interlocking with the recesses of the carton above (cf. FIG. 1A).

The tabs 8 and 9 are for example centered with respect to the corresponding lateral face. They may also be arranged symmetrically with respect to the center C of the upper face 6.

The bottom consisting of the lower face 7 comprises, plumb with the tabs 8 and 9, rectangular recesses 13 and 14 of the same dimension as the tabs with an adjustment tolerance of less than a millimeter, thus permitting perfect interlocking between tab of a lower carton and recess of an upper carton.

Represented in FIG. 2 is the blank 15 whereby the carton 1 of FIG. 1 was made.

The blank 15 comprises a set of four main leaves 7, 4, 6 and 2 which is terminated by a gluing tab 16 running over the whole length of the leaves.

The leaves are connected together by fold lines or join lines 17.

The set of leaves is bordered on one side by a first series 18, of upper flaps, and on the other side by second series 19, of lower flaps.

More precisely each main leaf comprises an upper flap and a lower flap.

The leaves 2 and 4, which are able to form lateral faces of the carton, each comprise a mutually identical, rectangular upper leaf 18' and lower leaf 19'.

The leaves 18' and 19' are laid out so as to form the internal part of the lateral walls 3 and 5 of the carton 1, for example by being adjoining at the level of their ends when the carton is made.

The leaf 6 intended to form the cover of the carton is itself connected by fold lines 11 to two rectangular flaps 18" and 19" which comprise the rectangular tabs 8 and 9.

Each tab is cut out on three sides 20 in the corresponding flap and is connected to the leaf 6 on the fourth side 21 by the double fold line 12.

A recess 22 or 23, sufficiently wide to allow good clearance of the tab with respect to the flap, for example between 1 mm and 5 mm wide, for example 3 mm wide, is respectively provided around the tabs 8 and 9.

This recess enables the tabs 8 and 9 to be kept horizontal, extending ahead of the leaf 6 when the flaps 18" and 19" are folded around a mandrel, during the formation of the carton.

It is then sufficient to push from underneath and to fold the tab down toward the leaf 6 around the double fold line 12 in order to glue the said tab in a projecting position so as to constitute the centering means according to the invention.

Lastly, the leaf 7 is itself connected via fold lines 24 perpendicular to the lines 17 to two rectangular flaps 18'" and 19'" of dimensions equal to those of the flaps 18" and 19", but without tabs, the transverse dimension of the flaps 18", 18'", 19" and 19'" being such that the said flaps are adjoining pairwise along the line 25 when the carton 1 is formed (cf. FIG. 1).

The leaf 7 comprises the two rectangular recesses 13 and 14, for example made in one part only of the thickness of the cardboard if it is double-walled, of which the end 26 situated on the side of the flap straddles the fold line 24, thereby making it possible, once the carton has been formed, to allow a bigger overthickness of recess 27 plumb with the line 12, allowing better interlocking with the bigger projection 28 due to the offsetting of the double line 12.

FIG. 1A thus shows diagrammatically in section the interlocking of the projection 28' of the carton 1' in the recess 27 of the carton 1.

Such adjustments are possible with the desired accuracy, in particular because the cartons are formed around mandrels as described in document FR 8803719.

Figure 4A:
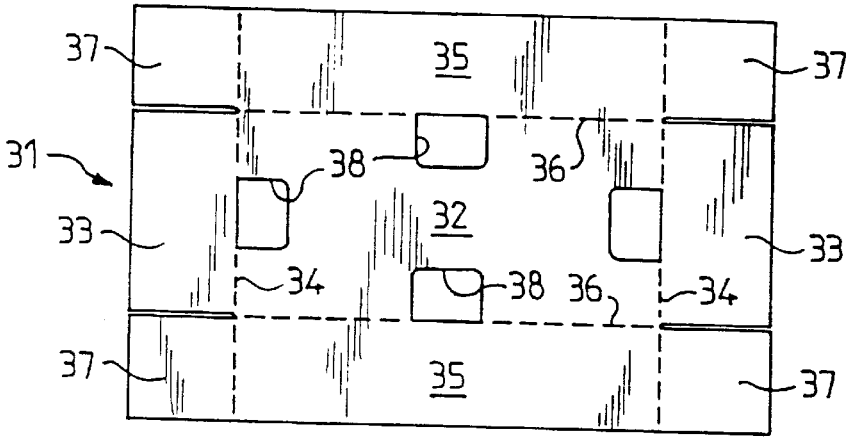
FIGS. 4A and 4B show the blanks making it possible respectively to obtain the said lower part of FIG. 3 and the cover of the corresponding carton.
Figure 4B:
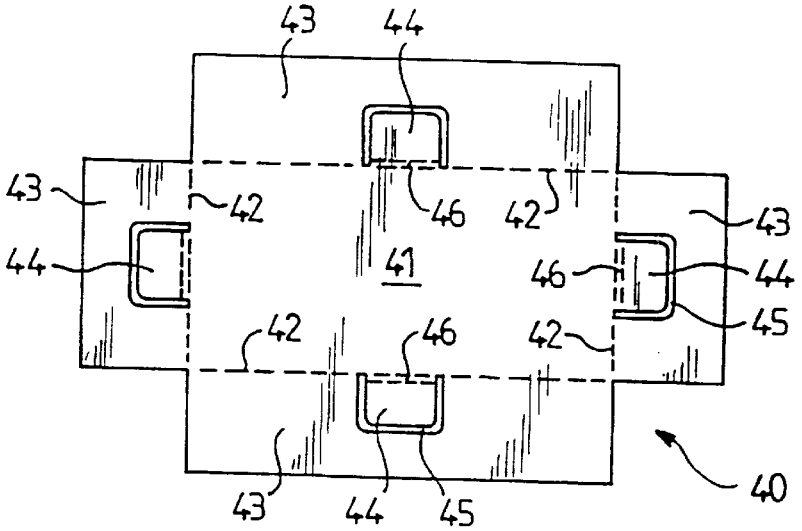

FIGS. 3, 4A and 4B show a parallelepipedal, open tray 30 formed by a blank 31 of a type known per se (cf. FIG. 4A), comprising a central leaf 32, furnished on each side with flaps, namely two identical first opposing rectangular flaps 33 connected to the central leaf 32 by fold lines 34 and two second rectangular flaps 35 connected to the leaf 32 by fold lines 36 perpendicular to the fold lines 34, and themselves comprising two identical third flaps 37, respectively connected to each lateral side, and intended to form by gluing with the rectangular flaps 33 two of the opposing lateral walls of the tray, the other two walls being formed by the flaps 35.

In the embodiment described here, four centering means are provided.

To do this, the central leaf 32 comprises four recessed parts 38, for example identical, centered with respect to the lateral walls of the carton, which are rectangular and one side 39 of which is substantially coincident with a central part of the fold lines 34 and 36.

FIG. 4B shows the blank 40 for constructing the cover of the carton obtained with the tray 30 of FIG. 3.

The blank 40 comprises a rectangular central leaf 41 connected by pairwise perpendicular fold lines 42 to rectangular flaps 43.

Each flap 43 comprises a tab 44 according to the invention, for example rectangular, cut out on three sides in the flap by making a peripheral recess 45, and connected on the side of the central leaf 41 to the said central leaf by a double fold line 46, or by a single fold line offset to the inside of the tab.

The tabs 44 have a complementary shape to that of the recesses 38 and are therefore laid out so as to be turned over and glued, for example with "hot melt" glue, to the outside face of the leaf 41.

The remaining parts of the flaps 43 are themselves glued to the external faces of the flaps 33 and 35 of the tray 30.

Figure 5:
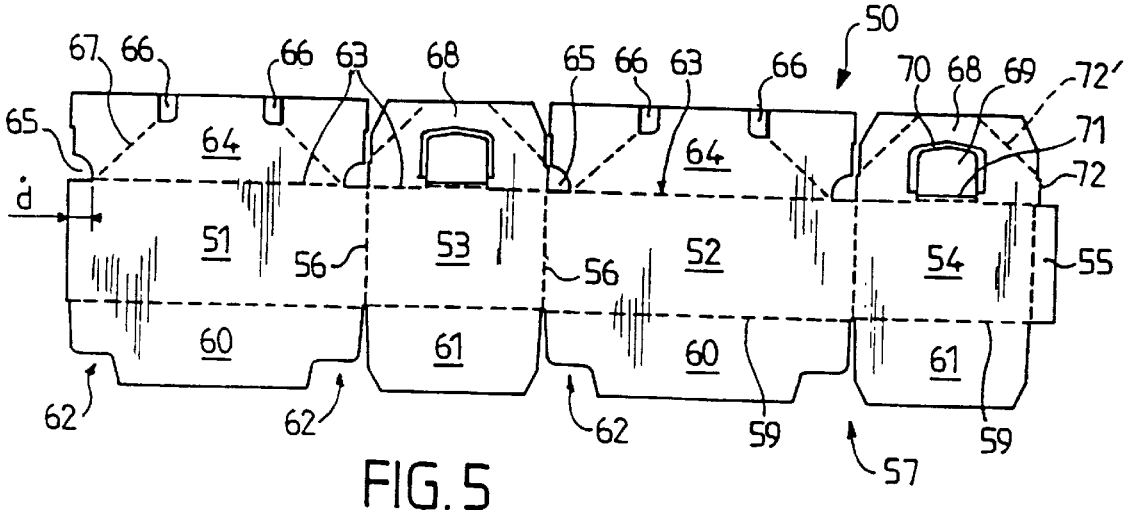
FIG. 5 is a plan view of another embodiment of a blank according to the invention with four leaves.

FIG. 5 shows a blank 50 comprising a set of four lateral leaves, namely two large rectangular leaves 51 and 52 interspersed with two small rectangular leaves 53 and 54.

The set of leaves is terminated on one side by a tab 55 able to be fixed to the periphery of the end leaf 51. The leaves are connected together by first parallel fold lines 56.

The blank comprises a first series 57 of flaps situated on one side of the leaves and intended to form the bottom of the carton, and a second series 58 of flaps situated on the other side of the leaves and intended to form the cover of the carton.

More precisely, the first series 57 comprises four substantially rectangular flaps connected to the lateral sides of the four leaves by aligned fold lines 59 perpendicular to the first fold lines, namely two large identical flaps 60, termed external and connected to the large leaves 51 and 52 and two identical small flaps 61 termed internal and connected to the small leaves 53 and 54.

In the embodiment more particularly described here, the two large flaps 60 exhibit a width, in the transverse direction, which is equal to or substantially equal to half the width of the closed carton.

Each large external flap 60 comprises two lateral sides terminated on the side of the corner with the peripheral border parallel with the fold line 59, by an indentation 62 of rectangular shape complementary to that of a half-tab which will be described later.

The small internal flaps 61 are themselves identical and rectangular.

The second series 58 of flaps is connected to the four main leaves by third fold lines 63 perpendicular to the first fold lines 56.

It comprises two substantially rectangular external identical large flaps 64. Each external flap 64 comprises two lateral sides each furnished with a notch 65 in the shape for example of a portion of a circle, at the corner joining with the fold lines 63, so that the said fold line terminates in a portion which is free of any flap over a distance d, which portion may advantageously lie slightly underneath the said line, to allow better interlocking.

The borders of the flaps 64 opposite the third fold lines furthermore comprise two half-slits 66 situated on either side of the flaps, at a specified distance from the lateral borders of the said flaps.

Each end of the half-slits is extended by a sectile line 67 over a specified distance, directed on a slant toward the corner angle of the flap with the third fold line, so as to culminate at the end of the cutout 65, joining with this fold line.

The width of the flaps 64, between the third fold lines 63 and the peripheral borders is equal to half the width of the cover of the carton so that, when it is formed, the said borders are adjoining, the half-slits 66 opposing one another so as to form two parallel identical slits lying astride the join between flaps.

The small flaps 68 are themselves rectangular, for example of the same width as the large flaps 64.

They each comprise a rectangular tab 69 cut out on one side in the flap by making, over the larger part of its periphery, that is say right around except over a small portion on either side at the level of the fold line, a peripheral recess 70, and connected on the other side to the leaf 53 or 54 by a fold line 71 slightly offset toward the inside of the flap, by one thickness of cardboard for example, with respect to the third fold line 63, which spreads out either side of the said tab, centered with respect to the flap.

The small flaps 68 comprise on each lateral face, at the level of the join with the fold line 63, a rectangular projecting part 72 laid out so as to cooperate with the recessed part 65, in such a way that it will rest on the upper border of the wall 51 or 52 which thus constitutes a support for the detachable flap part of the tab 69.

Lastly, provision is made for sectile lines 72', on a slant, cutting the upper corners of the small flaps, so as to allow better tearing off of the cover.

FIGS. 6 to 10 show the formation of a carton 73, constructed with a blank of the type corresponding to FIG. 5.

In what follows, the same reference numerals as for the blank of FIG. 5 will be used to denote the same elements.

The bottom 74 is formed in a manner known per se, with the recesses 75 according to the invention, obtained from the indentations 62.

The bottom of the carton being formed and the carton erected around a mandrel, the small internal flaps 68 are firstly folded down, the tabs 69 then being held naturally vertically plumb with the lateral sides 53 and 54 (cf. FIGS. 6 and 7) while freeing the corresponding recesses 70'.

The lateral parts 76 of the flaps 68 have been previously glued, with "hot melt" glue for example, by spots or lines of glue 77, over a portion sufficient to allow good fixing of the flaps to one another, but inside the internal flap with respect to the sectile lines 67 of the external flaps 64.

The internal flaps do not sink inward moreover, the projecting parts 72 coming to bear on the upper border of the walls 64, thereby preventing slumpping by virtue of the counter pressure thus exerted.

The external flaps 64 are next folded down (cf. FIG. 8) forming the slits 78, and are applied to the internal flaps 68. The sectile lines 67 are completely outside the gluing spots and/or lines 77, and this will allow easy tearing off of the cover when the user pulls from the slits 78. allow easy tearing off of the cover when the user pulls from the slits 78.

Gluing lines 79 have moreover been provided previously on the upper external face of the external flaps 64 square with the tabs 69.

Lastly, (cf. FIG. 9), the tabs 69 are folded down and glued to the upper face of the external flaps 64 to produce the means of centering by tab according to the invention.

Figure 10:
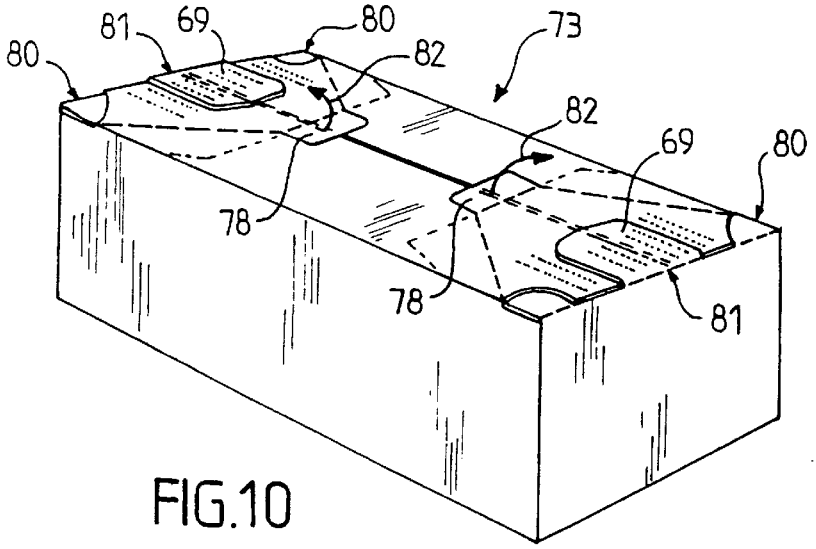
FIG. 10 is a perspective view of the carton of FIGS. 6 to 9 once formed.
Figure 6:
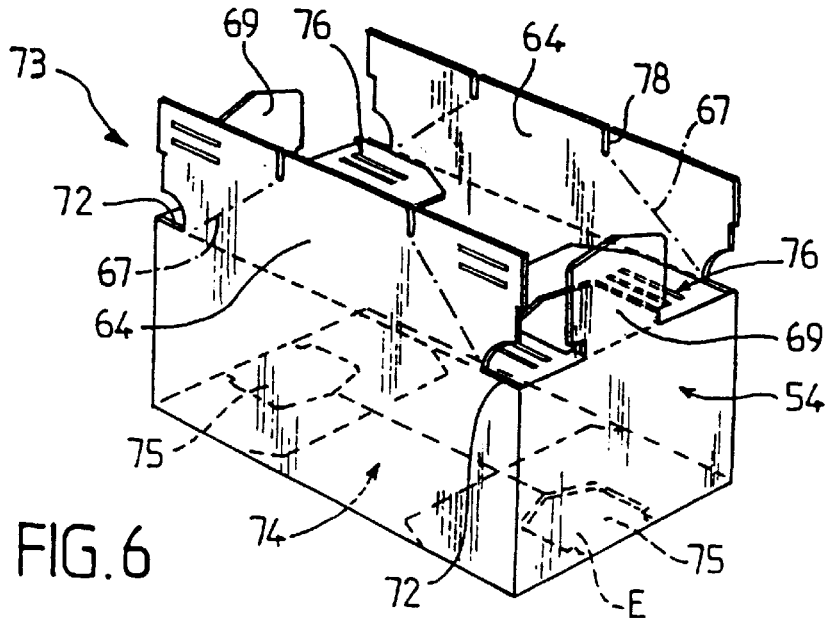
FIG. 6 is a perspective view of the carton, cover open, according to the blank of FIG. 5.
Figure 7:
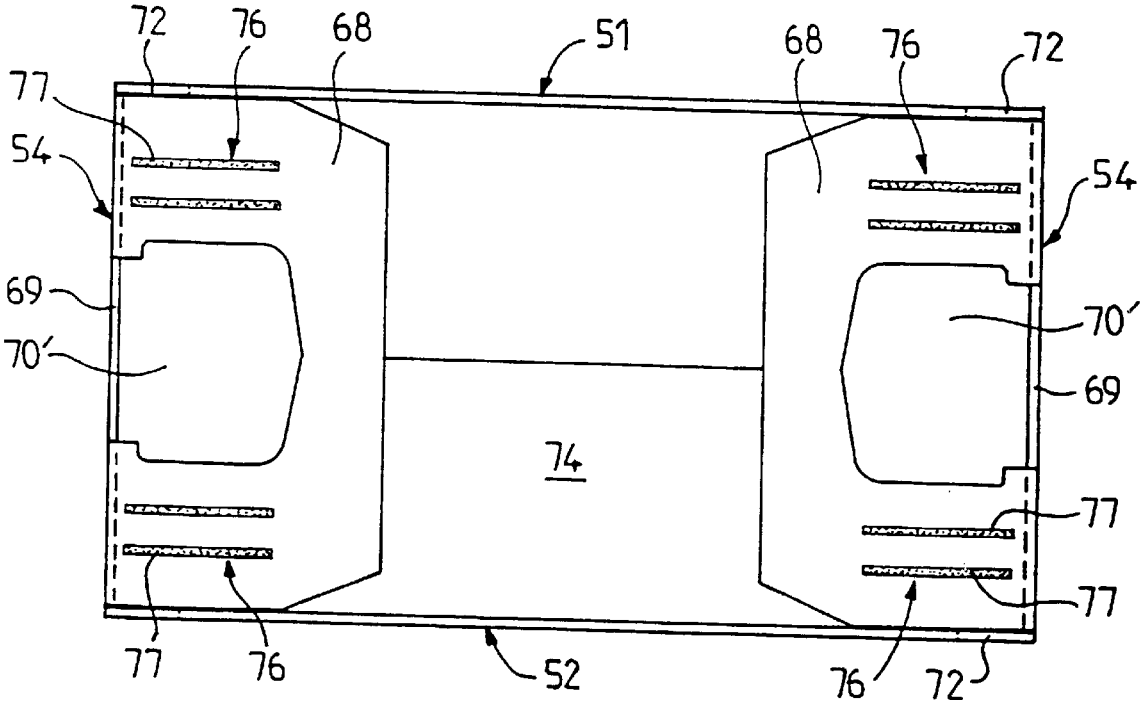
FIGS. 7, 8 and 9 are views from above of the carton of FIG. 5 showing the successive formation of the cover.
Figure 8:
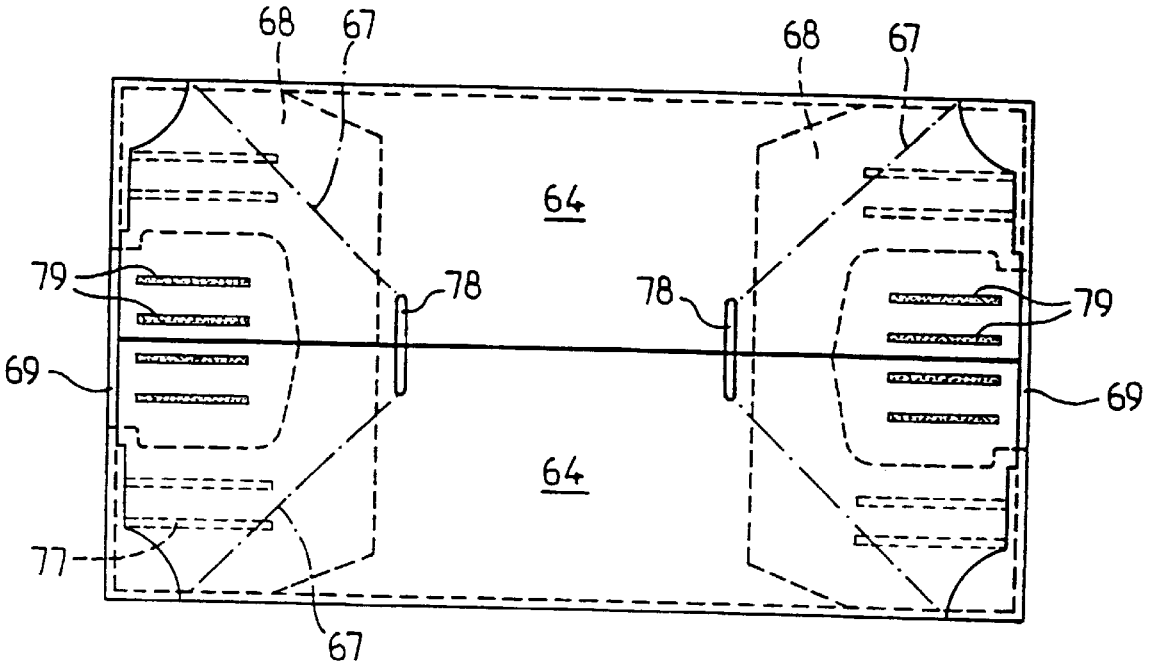
Figure 9:
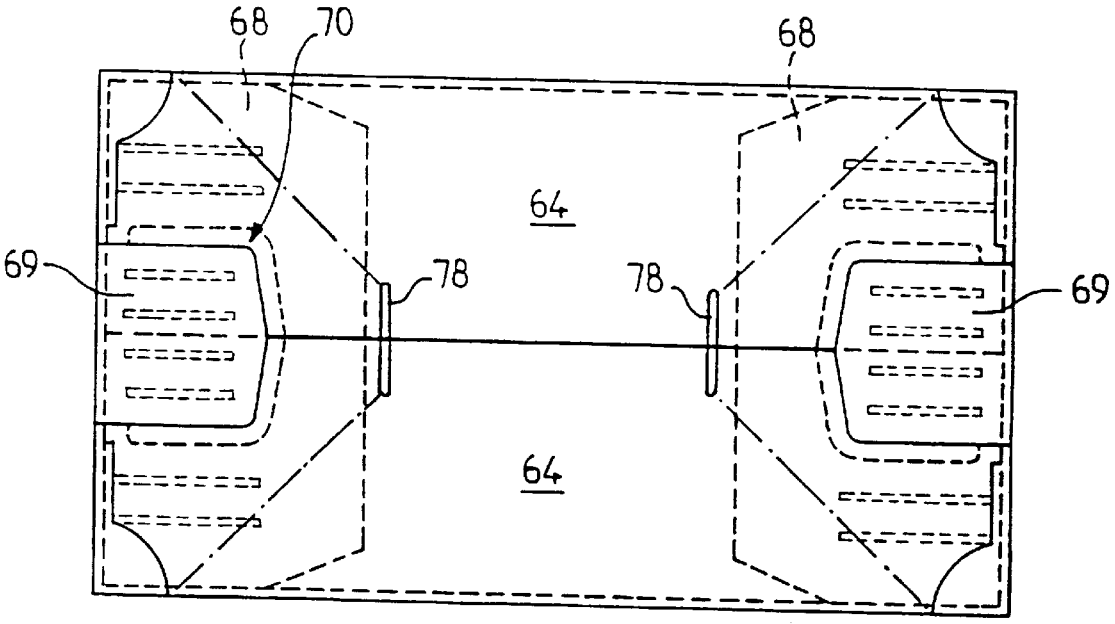

Represented in FIG. 10 is a perspective view of the carton 73 thus obtained, with its antidip corners 80 formed by the projections 72 in the notches 65, and its outgrowth-like centering tabs 69, in particular with an offset at 81 to facilitate interlocking, as outlined with reference to FIGS. 1 and 1A.

To open the extremely sturdy and rigid carton, it is sufficient to pull in the direction of the arrows 82, as described above.

Figure 11:
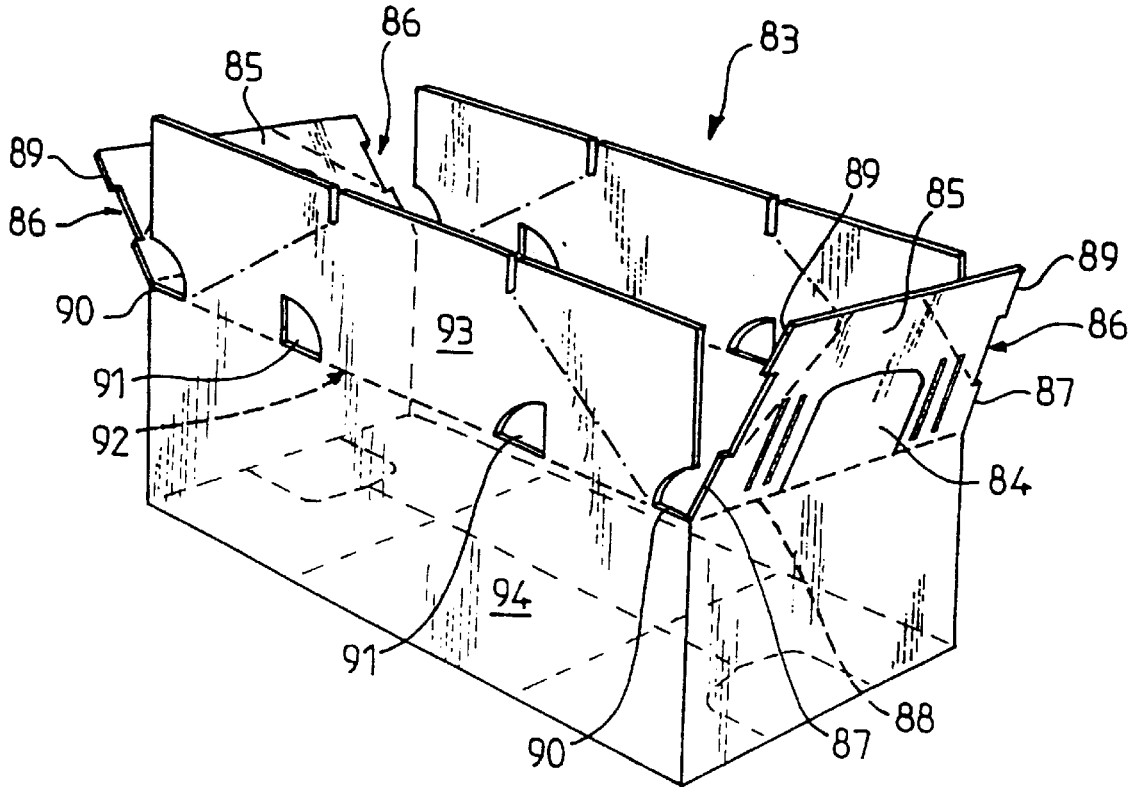
FIG. 11 is a perspective view of a fourth embodiment of a carton according to the invention, cover open.
Figure 12:
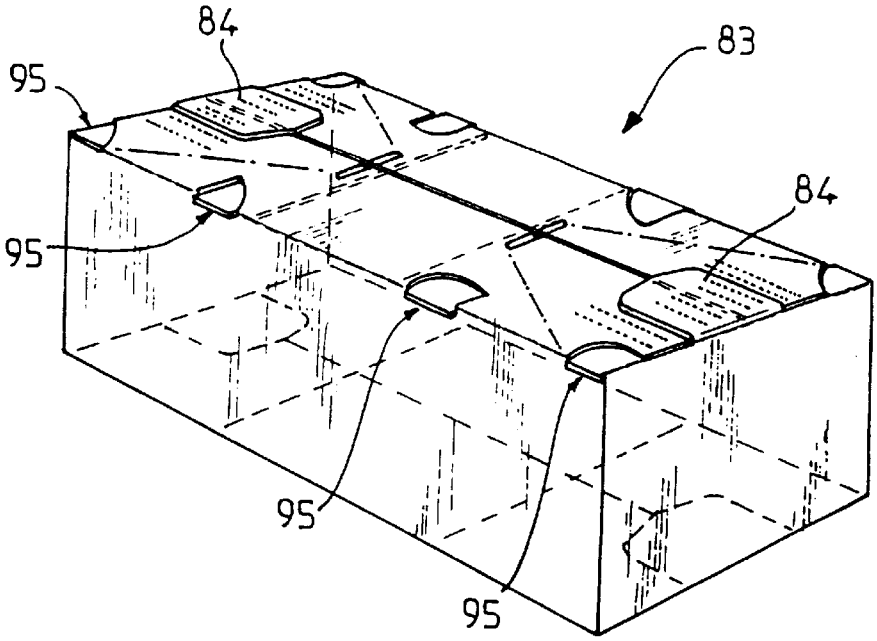
FIG. 12 is a perspective view of the carton of FIG. 11, cover closed.

FIGS. 11 and 12 show a variant of the carton described with reference to FIGS. 5 to 10.

More precisely, FIGS. 11 and 12 show a carton 83 furnished with tabs 84 cut out in internal flaps 85.

On its lateral borders 86, each internal flap 85 comprises two rectangular projecting parts 2 to 5 mm wide, namely a first projecting part 87 at the corner joining with the fold line 88, as described with reference to FIG. 5, and a second, end, projecting part 89 situated at the end corner of the flap opposite the fold lines 88.

Each projecting part 87 and 89 is laid out so as to rest and snap-fit into a corresponding recess 90 and 91 made at the level of the line of fold 92 of the external flap 93 with the lateral side of the carton 94.

When the flaps have been successively folded down onto one another and glued as described above, a carton according to FIG. 12 is thus obtained, with eight antidip projections 95.

Here again the sandwiching of the external flaps between internal flaps and tabs permits excellent squaring up and locking of the carton, which behaves like an extremely sturdy rigid block.

Figure 13:
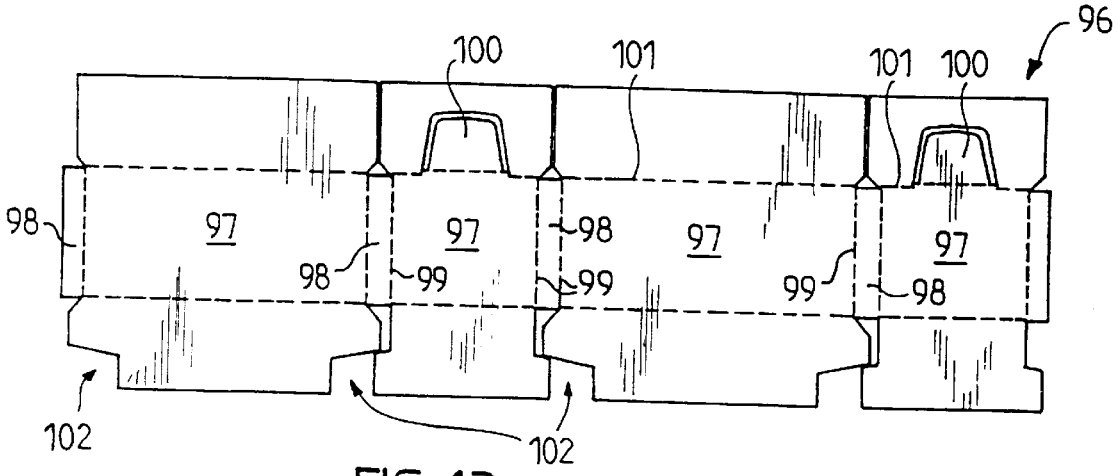
FIG. 13 is a plan view of another embodiment according to the invention of a blank with eight sides.

FIG. 13 shows another embodiment of a blank 96 according to the invention for an eight-sided carton with cut corners.

The blank 96 comprises four main leaves 97 and four intermediate leaves 98 which are able to form the cut corners of the carton, the said intermediate leaves being devoid of flaps, the set being terminated by a fixing tab able to be fixed to the intermediate leaf 98 stuck to the main end leaf 97.

The leaves are connected together by first parallel fold lines 99.

Here again, the blank comprises a first series of flaps intended to form the bottom and a second series of flaps including those with tab 100 as described with reference to the blank of FIG. 5.

Each flap of the second series exhibits two lateral sides having a first part slanting at 45° toward the outside of the flap from second fold lines 101 which are aligned, the said slanting part being laid out so as to enshroud the adjacent intermediate leaf when the carton is formed.

The large external flaps of the first series also comprise this slanting part and end indentations 102 to form the recesses of the bottom according to the invention, as described with reference to FIG. 5.

Figure 14:
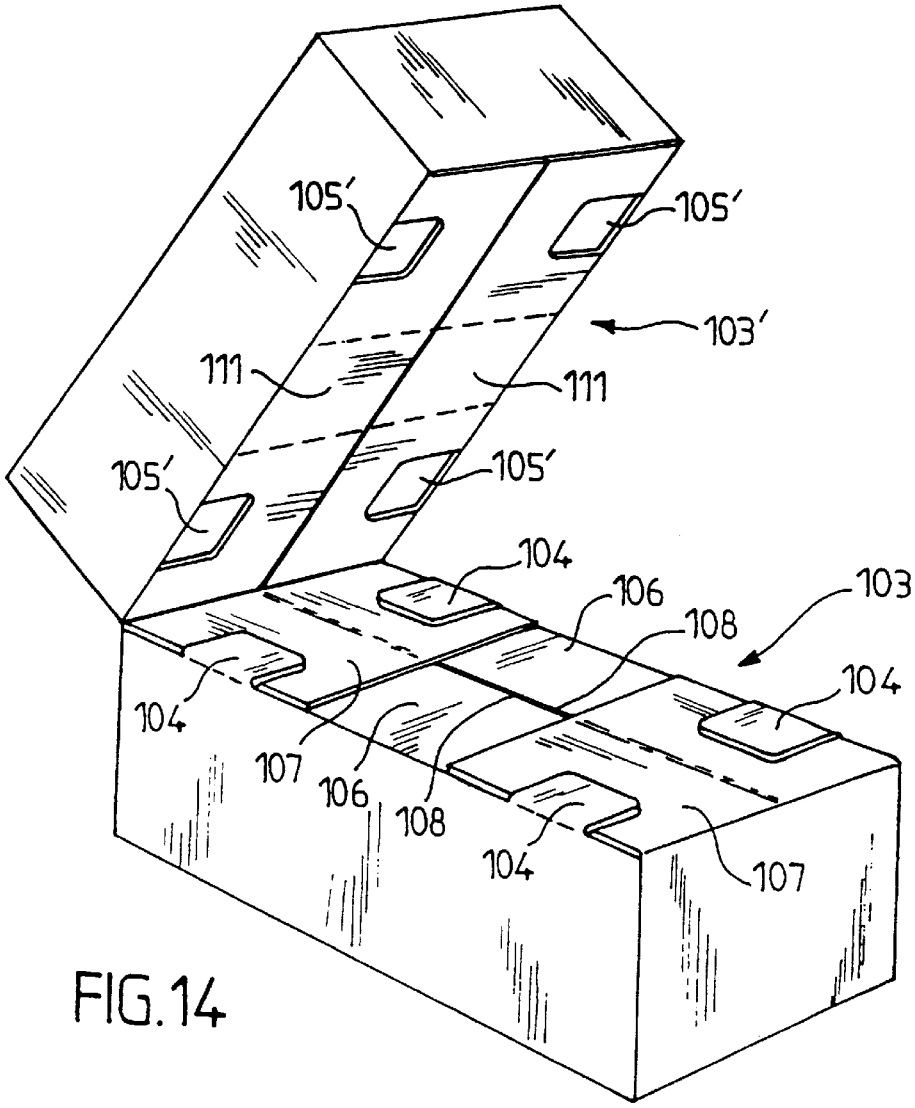
FIG. 14 shows in perspective another embodiment of cartons according to the invention, with four centering tabs, demonstrating the possibilities of engagement between cover and bottom.

FIG. 14 shows two cartons 103, 103' according to another embodiment of the invention, comprising four tabs 104 and four corresponding recesses 105'.

Here, two tabs 104 are provided at each end of the large flaps 106 which here are internal, the small flaps 107 being sandwiched between the remaining, perforated part of the large flap and the two opposing tabs of the two large flaps, whose borders 108 are moreover adjacent so as to ensure closure of the cover.

Figure 15:
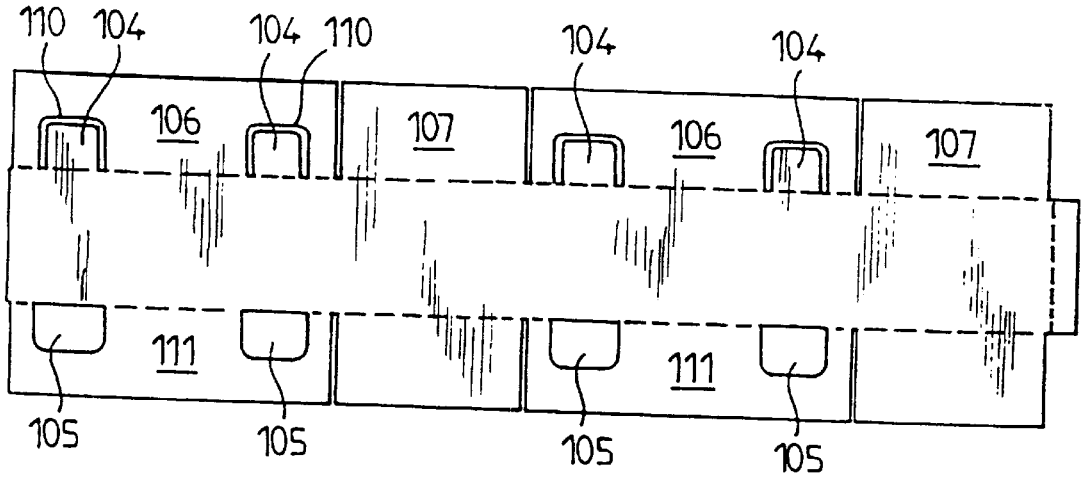
FIG. 15 is the blank in plan of the carton of FIG. 14.

Represented in FIG. 15 is the blank 109 for obtaining the carton 103 of FIG. 14.

The tabs are designed in an identical manner to that described previously. They are cut out in the so-called internal flaps 106 with peripheral recess 110, the external flaps 107 being simply rectangular.

The recesses are themselves made in the rectangular flaps 111 of dimension which are identical to that of the flaps 106, intended to form the bottom.

The recesses have dimensions complementary to the tabs as described previously.

One of the important elements in several embodiments of the invention resides in the offset at the level of the fold line of the tabs, which may be achieved either through a double fold, or quite simply through an offset in the fold line, this offset always being greater than or equal to the thickness of the cardboard, toward and inside the tab.

The offset at the level of the join of the tabs and at the level of the plumb recess, considerably favors interlocking and therefore further bolsters the stacking of cartons.

Such adjustments are moreover possible since the cartons may be made with sufficient accuracy, in particular because they are formed around a mandrel.

As is self-evident and as results moreover from the foregoing, the present invention is not limited to the embodiments more particularly described here. On the contrary it embraces all variants thereof and in particular those in which it furthermore includes an extra sheet of cardboard for reinforcing the bottom so as to avoid holes or orifices and those in which the joining borders between flaps of the bottom are slanted and not perpendicular with respect to the opposing lateral faces in a centered manner.

What is claimed is:

1. Carton comprised of sheet material and having a polygonal cross section, comprising:

a plurality of lateral faces;

a cover adapted to engage said lateral faces, said cover comprising an upper face and a plurality of upper lateral edges corresponding to said plurality of lateral faces; and a bottom adapted to engage said lateral faces, said bottom comprising a lower face; wherein:

said cover comprises at least two tabs disposed on said upper face proximate at least two of said upper lateral edges of said cover, said tabs being comprised by a portion of at least one of said cover and said lateral faces, each of said tabs being articulated on a line substantially coincident with said upper lateral edges said tabs so as to be adapted to overlap a portion of said upper face such that said tabs project from said upper face, said tabs further being adapted to be secured to said upper face;

and said bottom defines at least two recesses in said lower face corresponding to said tabs, said recesses being of complementary shape to said tabs and being arranged so as to engage corresponding tabs of a carton disposed underneath said lower face, whereby precise stacking of said carton on the carton underneath is enabled.

2. Carton according to claim 1, wherein at least a part of said bottom and said lateral faces comprise an integral structure, and wherein said cover comprises at least one lateral flap disposed on at least one of said upper lateral edges, at least one of said at least two tabs comprising a portion of said at least one lateral flap.

3. Carton according to claim 2, wherein said bottom and said lateral faces are comprised by a blank, said blank comprising at least four main leaves defining main leaf join lines therebetween such that said blank is adapted to be folded at said main leaf join lines to form said lateral faces from said main leaves, said blank further comprising a lower flap connected to each of said main leaves and a lower flap join line defined between each of said main leaves and said lower flaps such that said blank is adapted to be folded at said lower flap join lines to form said bottom from said lower flaps.

4. Carton according to claim 1, wherein said carton is comprised by a blank, said blank comprising at least four main leaves defining main leaf join lines therebetween such that said blank is adapted to be folded at said main leaf join lines to form said lateral faces from said main leaves, said blank further comprising a lower flap connected to each of said main leaves and a lower flap join line defined between each of said main leaves and said lower flaps such that said blank is adapted to be folded at said lower flap join lines to form said bottom from said lower flaps, wherein said recesses are defined in said lower flaps, said blank further comprising an upper flap connected to each of said main leaves and an upper flap join line defined between each of said main leaves and said upper flaps such that said blank is adapted to be folded at said upper flap join lines to form said cover from said upper flaps, wherein said tabs are comprised by a portion of said lateral faces.

5. Carton according to claim 1, wherein said carton is comprised by a blank, said blank comprising at least four main leaves defining main leaf join lines therebetween such that said blank is adapted to be folded at said main leaf join lines to form said cover from a first of said main leaves, to form said bottom from a second of said main leaves, and to form all but two of said lateral faces from a remainder of said main leaves, said blank further comprising an upper flap connected to each of said main leaves and a lower flap connected to each of said main leaves and defining upper flap join lines between said main leaves and said upper flaps and lower flap join lines between said main leaves and said lower flaps, said blank being adapted to be folded at said upper flap join lines to form one of said lateral faces from said upper flaps, said blank being adapted to fold at said lower flap join lines to form another of said lateral faces from said lower flaps, wherein said tabs are comprised by a portion of said lower flap and said upper flap connected to said first of said main leaves, the recesses being defined in said second of said main leaves.

6. Carton according to claim 1, wherein said bottom comprises a plurality of lower lateral edges corresponding to said plurality of lateral faces, said bottom being comprised by two lower internal flaps connected to said lateral faces at a first opposite pair of said lower lateral edges, said bottom being further comprised by two lower external flaps disposed over at least a part of said lower internal flaps and being connected to said lateral faces at a second opposite pair of said lower lateral edges, and wherein said cover is comprised by two upper internal flaps connected to said lateral faces at a first opposite pair of said upper lateral edges, said cover being further comprised by two upper external flaps disposed over at least a part of said upper internal flaps and being connected to said lateral faces at a second opposite pair of upper lateral edges, wherein said recesses are defined in said lower external flaps, and wherein said tabs are comprised of said upper internal flaps, and are disposed over said upper external flaps.

7. Carton according to claim 6, wherein at least one of said upper and lower external flaps defines notches at corners thereof adjacent at least one of said upper and lower lateral edges, and wherein at least one of said upper and lower internal flaps comprise projecting parts adapted to snap-fit into said notches.

8. Carton according to claim 6, wherein at least one of said upper and lower external flaps defines intermediate notches adjacent at least one of said upper and lower lateral edges, and wherein at least one of said upper and lower internal flaps comprise opposing end projecting parts adapted to snap-fit into said intermediate notches.

9. Carton according to claim 1, wherein said carton comprises four tabs arranged in opposing pairs, said tabs being glued to said upper face of said cover, said carton further comprising four recesses.

10. Carton according to claim 1, wherein said carton comprises at least two peripheral recesses, said peripheral recesses defining said tabs.

11. Carton according to claim 1, wherein said tabs are of a shape selected from the group consisting of rectangular and isosceles trapezoidal.

12. Carton according to claim 1, wherein said carton comprises corners and rupture slits therethrough, said carton further comprising rupture lines, said rupture lines connecting said rupture slits and said corners so as to cause said carton to open by a tearing off of said cover when a pulling force is applied at said slits.

13. Carton according to claim 1, wherein said carton comprises eight lateral faces, said eight lateral faces comprising four main lateral faces and four intermediate lateral faces, said lateral faces being arranged such that each intermediate lateral face is disposed between two adjacent main lateral faces.

14. Set of blanks of sheet material, said set being adapted to form a carton, said carton being of polygonal cross section comprising
- a plurality of lateral faces,
- a cover comprising corners, an upper face and a plurality of upper lateral edges corresponding to said plurality of lateral faces, and
- a bottom,
  - said cover further comprising at least one tab disposed on said upper face adjacent at least one of said upper lateral edges,
  - said bottom defining at least one recess in said lower face corresponding to said tabs, said recess being of complementary shape to said tab and being arranged so as to engage a corresponding tab of a carton disposed underneath said carton, whereby precise stacking of said carton on the carton underneath is enabled, said set of blanks comprising:

a first blank adapted to form said cover, said first blank comprising a leaf adapted to form said upper face, said first blank further comprising at least one lateral flap connected to said leaf, said first blank defining an upper flap join line between said leaf and said at least one lateral flap such that said first blank is adapted to be folded thereat, said first blank comprising at least one tab section connected to at least one of said leaf and said at least one lateral flap and defining a tab join line thereat, such that said at least one tab section is adapted to be folded at said tab join line onto said upper face to form said at least one tab, wherein said tab join line is offset from said flap join line; and a second blank adapted to form said bottom, said second blank comprising a lower leaf defining said at least one indentation therein; and a third blank adapted to form said lateral faces.

15. Set of blanks according to claim 14, wherein said tab sections are shaped such that said tabs are of a shape selected from rectangular and isosceles trapezoidal.

16. Set of blanks according to claim 14, wherein said first blank defines at least one peripheral recess, said at least one peripheral recess defining said at least one tab section.

17. Set of blanks according to claim 14, wherein said cover defines rupture slits therethrough.

18. Set of blanks according to claim 17, further comprising rupture lines adapted to connect said rupture slits and said corners so as to cause said carton to open by a tearing off of said cover when a pulling force is applied to said slits.

19. Set of blanks of sheet material, said set being adapted to form a carton, said carton being of polygonal cross section comprising
- a plurality of lateral faces,
- a cover comprising corners, an upper face and a plurality of upper lateral edges corresponding to said plurality of lateral faces, and
- a bottom,
  - said cover further comprising at least one tab disposed on said upper face adjacent at least one of said upper lateral edges,
  - said bottom defining at least one recess in said lower face corresponding to said tabs, said recess being of complementary shape to said tab and being arranged so as to engage a corresponding tab of a carton disposed underneath said carton, whereby precise stacking of said carton on the carton underneath is enabled, said set of blanks comprising:

a first blank adapted to form said cover, said first blank comprising a leaf adapted to form said upper face, said first blank further comprising lateral flaps connected to said leaf, said first blank defining flap join lines between said leaf and said lateral flaps such that said first blank is adapted to be folded thereat, said first blank comprising at least one tab section connected to at least one of said leaf and said lateral flaps and defining a tab join line thereat, such that said at least one tab is adapted to be folded at said tab join line onto said upper face, upper face to form said at least one tab;

a second blank adapted to form said bottom, said second blank comprising a at least four main leaves defining main leaf join lines therebetween such that said blank is adapted to be folded at said main leaf join lines, said blank further comprising a lower flap connected to each of said main leaves and a lower flap join line defined between each of said main leaves and said lower flaps such that said blank is adapted to be folded at said lower flap join lines, said blank further defining at least one recess therein.

20. Set of blanks according to claim 19, wherein said leaf defines rupture slits therethrough.

21. Set of blanks according to claim 20, further comprising rupture lines adapted to connect said rupture slits and said corners so as to cause said carton to open by a tearing off of said cover when a pulling force is applied to said slits.

22. Set of blanks according to claim 19, wherein said tab sections are shaped such that said tabs are of a shape selected from rectangular and isosceles trapezoidal.

23. Set of blanks according to claim 19, wherein said blank defines at least one peripheral recess defining said at least one tab section.

24. Blank of corrugated sheet material, said blank being adapted to form a carton, said carton being of polygonal cross-section comprising at least four lateral faces, a cover comprising corners, an upper face and a plurality of upper lateral edges corresponding to said plurality of lateral faces, and a bottom, said cover further comprising at least two tabs disposed on said upper face adjacent at least two of said upper lateral edges, said bottom defining at least two recesses in said lower face corresponding to said tabs, said recesses being of complementary shape to said tabs and being arranged so as to engage corresponding tabs of a carton disposed underneath said carton, whereby precise stacking of said carton on the carton underneath is enabled, said blank comprising:

at least four main leaves defining main leaf join lines therebetween such that said blank is adapted to be folded at said main leaf join lines, said blank further comprising a lower flap connected to each of said main leaves and a lower flap join line defined between each of said main leaves and said lower flaps such that said blank is adapted to be folded at said lower flap join lines, said blank further comprising an upper flap connected to each of said main leaves and an upper flap join line defined between each of said main leaves and said upper flaps such that said blank is adapted to be folded at said upper flap join lines, said blank further comprising at least one tab section on at least one of said leaves, said upper flaps, and said lower flaps and define a tab join line thereat, such that said at least one tab section is adapted to be folded at said tab join line to form said at least one tab, said blank further defining at least one recess therein.

25. Blank according to claim 24, wherein at least two of said upper flaps are upper internal flaps and at least two of said upper flaps are upper external flaps, said upper external flaps being adapted to be disposed over at least a part of said upper internal flaps, said tab sections being comprised of said upper internal flaps and being adapted to be disposed over said upper external flaps; and wherein at least two of said lower flaps are lower internal flaps and at least two of said lower flaps are lower external flaps, said lower internal flaps being adapted to be disposed over at least a part of said lower external flaps, said recesses being defined in said lower external flaps.

26. Blank according to claim 25, wherein said external flaps define rupture slits therethrough.

27. Blank according to claim 26, further comprising rupture lines adapted to connect said rupture slits and said corners so as to cause said carton to open by a tearing off of said cover when a pulling force is applied at said slits.

28. Blank according to claim 24, wherein said upper flaps are adapted to form said cover, said at least one tab section being adapted to form said tabs on at least one of said upper flaps, and wherein said lower flaps are adapted to form said bottom, said at least one recess being defined in at least one of said lower flaps.

29. Blank according to claim 24, wherein a first of said main leaves is adapted to form said cover, said at least one tab section being adapted to form said tabs on said first main leaf, and wherein a second of said main leaves is adapted to form said bottom, said at least one recess being defined in said second main leaf, and wherein said upper flaps are adapted to form one of said lateral faces, said lower flaps are adapted to form one of said lateral faces, and a remainder of said main leaves are adapted to form a remainder of said lateral faces.

30. Blank according to claim 24, wherein said tab sections are shaped such that said tabs are of a shape selected from rectangular and isosceles trapezoidal.

31. Blank according to claim 24, wherein said blank defines at least one peripheral recess defining said at least one tab section.

* * * * *